United States Patent [19]

Schäfer et al.

[11] 4,246,509

[45] Jan. 20, 1981

[54] GAS DISCHARGE LAMP WITH ABOUT 4 PARTS NITROGEN AND 1 PART XENON

[75] Inventors: Jürgen Schäfer, Hasselroth; Günter Thomas, Hanau, both of Fed. Rep. of Germany

[73] Assignee: Original Hanau Quarzlampen GmbH, Hanau am Main, Fed. Rep. of Germany

[21] Appl. No.: 949,879

[22] Filed: Oct. 10, 1978

[30] Foreign Application Priority Data

Oct. 29, 1977 [DE] Fed. Rep. of Germany ..... 2748731

[51] Int. Cl.[3] ..... H01J 17/20; H01J 61/12

[52] U.S. Cl. ..... 313/224

[58] Field of Search ..... 313/224

[56] References Cited

U.S. PATENT DOCUMENTS

| | | | |
|---|---|---|---|
| 1,873,683 | 8/1932 | Von Wedel | 313/224 X |
| 3,449,615 | 6/1969 | Tucker et al. | 313/226 |
| 3,742,281 | 6/1973 | McInally | 313/184 |

FOREIGN PATENT DOCUMENTS

| | | | |
|---|---|---|---|
| 965429 | 6/1957 | Fed. Rep. of Germany . | |
| 1065530 | 9/1959 | Fed. Rep. of Germany . | |
| 707265 | 4/1954 | United Kingdom . | |
| 791999 | 3/1958 | United Kingdom . | |
| 830243 | 3/1960 | United Kingdom | 313/224 |
| 963700 | 7/1964 | United Kingdom . | |
| 978004 | 12/1964 | United Kingdom | 313/224 |
| 1443558 | 8/1973 | United Kingdom . | |

*Primary Examiner*—Robert Segal

*Attorney, Agent, or Firm*—Frishauf, Holtz, Goodman & Woodward

[57] ABSTRACT

To provide a continuous spectral output within the visible right range, particularly for spectroscopic and photometric purposes, the lamp has a fill of nitrogen and xenon mixed of $N_2$: Xe of 6:1 to 1:1, by volume, with an overall filling pressure in the range of 50 to 200 mbar, preferably at a mixing ratio of 4:1 with an overall fill pressure of 100 mbar.

2 Claims, 2 Drawing Figures

A
B
PRIOR ART
RELATIVE ENERGY
1000
800
600
400
200
0
200
400
600
800
1000
1200
1400
1600
1800
2000
2200
2400
[nm]
WAVELENGTH

GAS DISCHARGE LAMP WITH ABOUT 4 PARTS NITROGEN AND 1 PART XENON

The present invention relates to a gas discharge lamp, and more particularly to a Xenon gas discharge lamp for spectroscopic and photometric use which has a spectral output which is continuous essentially throughout the entire visible light range.

BACKGROUND AND PRIOR ART

Light sources are frequently needed for various scientific uses, particularly for spectroscopy and for photometric uses. Continuous spectral distribution of wave lengths in the visible light are provided by incandescent lamps or by Xenon lamps. The spectrum of the Xenon lamps, within the visible light range, is similar to the spectrum of a black body radiator of between 6200° to 6500° K. Due to the high operating pressure of such Xenon discharge lamps, the Xenon spectral lines are broadened and flattened out, and are overlapping to form an essentially continuous spectral output.

Xenon gas discharge lamps require substantial power input and the spectral distribution, as well as the operating characteristics of known Xenon lamps are difficult to control.

THE INVENTION

It is an object to provide a gas discharge lamp in which the light output is essentially continuous, but which has less power requirements than known Xenon lamps and which are easier to control in operation.

Briefly, the structure of a standard-Deuterium gas discharge lamp is essentially maintained but the fill has nitrogen mixed thereto, in a fill ratio of $N_2$:Xe in a range of from about 6:1 to 1:1, by volume, with an overall fill pressure of 50 to 200 millibar (mbar). In accordance with a feature of the invention, and in a preferred form, the mixing ratio $N_2$:Xe is about 4:1, with an overall filling pressure of 100 mbar.

If the preferred mixing ratio is used, a lamp voltage of 70 V is obtained having a lamp current of $J_B$ of 0.6 A. The power requirements of such a gas discharge lamp are less than 50 W. This permits operation of the gas discharge lamp with standard industrial lamp supply equipment which is used, for example, for spectral lamps of the Deuterium type.

Figure 1:
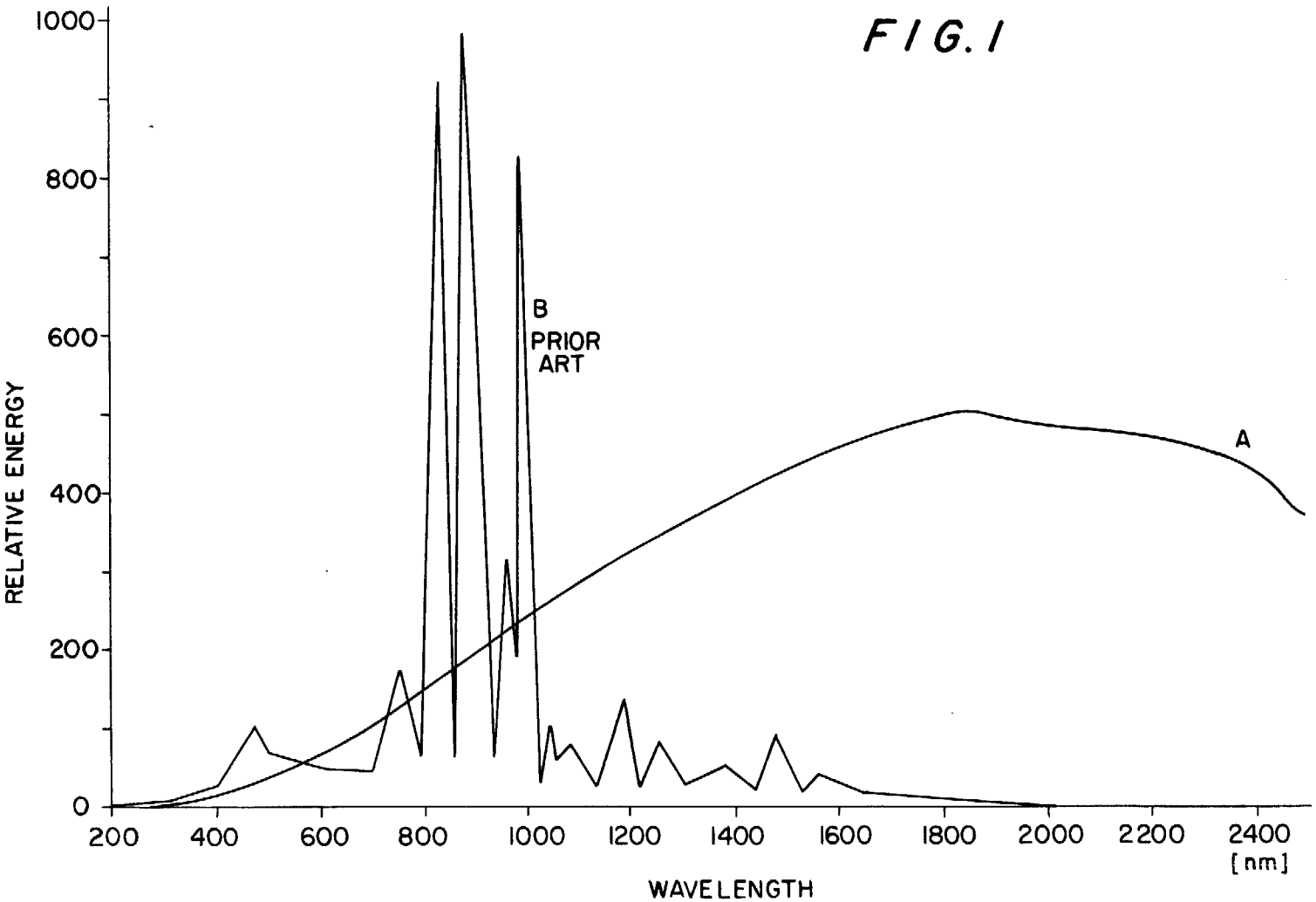
Figure 2:
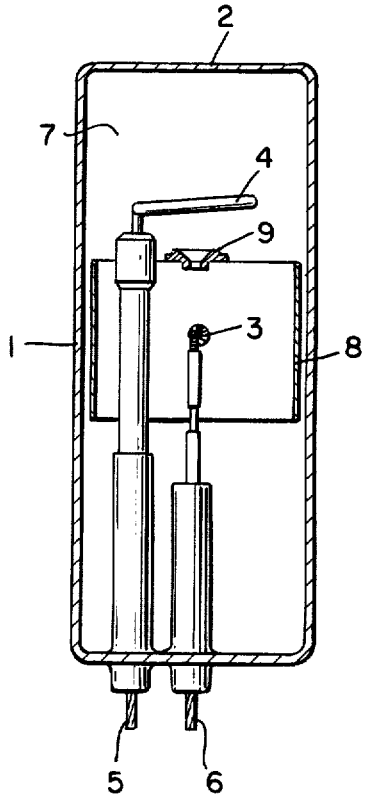

Drawings, illustrating operating characteristics and a preferred example, wherein:

FIG. 1 shows, in two graphs, the relative spectral distribution of the gas discharge lamp in accordance with the present invention (curve A) with respect to a prior art lamp (curve B); and FIG. 2 is a highly schematic longitudinal sectional view through a lamp in accordance with the present invention, the construction of which is essentially standard.

The lamp—with reference to FIG. 2:

An envelope or bulb 1 has a window 2 which is made of a material readily passing the wave lengths of the visible spectrum. A coiled electrode 3 is provided essentially along the axis of the lamp. The lamp, preferably, has a circular cross section. A counter electrode, of ring shape, is mounted axially spaced from the electrode 3. Electrode 3 is surrounded by a shield 8, which may be grounded or connected to a cathode terminal of the lamp, and is formed with a focussing lens 9. Connecting leads 5, 6 provide electrical connection to the electrodes. The interior 7 of the lamp housing or bulb 1 is, in accordance with the present invention, filled with a mixture of nitrogen and Xenon. The physical construction of the lamp itself is standard and reference is made to "Anleitung für die Deuteriumlampe D 200 F—ORIGINAL HANAU—" issued by Original Hanau, West-Germany.

The spectral distribution is shown in FIG. 1, wherein curve A shows the relative spectral distribution of a gas discharge lamp in accordance with the present invention with respect to light energy output. In the example from which the curve A was derived:

overall fill pressure: 130 mbar
mixing ratio of $N_2$:Xe=4:1
operating voltage: 60 V
operating current: 0.6 A.

Curve B shows the relative spectral distribution of a Xenon lamp of the prior art. Comparison of the spectral distribution of curve A and curve B clearly shows that the discharge lamp in accordance with the present invention has a light radiation characteristic which has an increasing portion of radiation in the longer wave part of the visible spectral range. The radiation emitted by the lamp has a reddish yellowish visible impression; a pure Xenon discharge lamp is yellowish-white.

The operating voltage of the gas discharge lamp, at a constant fill pressure of 100 mbar can be changed by changing the mixing ratio of $N_2$:Xe continuously , resulting in operating voltages between the limits of 12 V for pure Xenon and 120 V for pure nitrogen. The voltage gradient can thus be changed within wide limits, which is not possible when using Xenon lamps with only Xenon fill. The gas discharge lamp thus also permits substantially higher voltage gradients than possible in Xenon lamps without substantial change of the continuity of the light output within the visible spectral range.

It has been found, surprisingly, that the characteristic Xenon spectral lines which, in known Xenon lamps, are superimposed over the continuous spectral range output, have essentially entirely disappeared. The spectrum of the gas discharge lamp is free of Xenon lines.

The lamp is suitable for pulse operation.

Electrode 3 is heated filament, supplied with heater current of 2 to 12 V at 6 to 0.6 A, at least upon starting, preferably also during operation, through another electrode located physically behind the electrode 6 and not shown in FIG. 2. Assuming a constant mixing ratio of $N_2$:Xe=4:1, varying the fill pressure also permits variation of the operating voltage within some limits, and thus matching the operating voltage to available power supplies. Increase of the fill pressure results in an increase of operating voltage; for example, at a fill pressure of 75 mbar, an operating voltage of 50 V is required; at a fill pressure of 100 mbar, the operating voltage is 55 V, with a current of 0.6 A. At a fill pressure of 130 mbar, the operating voltage is 60 V with a current of 0.6 A. At a fill pressure of 200 mbar, an operating voltage of 70 V at a current of 0.6 A, resulting in a power input of 42 W will result. For structural reasons related to a lamp housing or bulb, the operating pressure of commercial-type lamps should preferably not exceed 200 mbar.

The ratio of $N_2$:Xe of 4:1 is preferred because an increase of the ratio would result in an increase in the appearence of the nitrogen bands in the spectrum whilst a decrease of the ratio of $N_2$:Xe would result in a decrease of the lamp voltage which causes a decrease of lamp efficiency.

We claim:

1. Gas discharge lamp particularly for spectroscopic and photomeric use and having an essentially continuous spectral output within the visible light range having a bulb or housing (1);

electrodes (3, 4) within the housing;

means (5, 6) supplying electrical current to the electrodes;

and a fill comprises a mixture of nitrogen and xenon within the bulb or housing wherein, in accordance with the invention, the nitrogen and xenon are present in the mixing range, by volume, of of xenon to nitrogen in a ratio of, for each part xenon, about 4 parts nitrogen, and with an overall fill pressure of about 100 millibar.

2. Lamp according to claim 4, wherein the lamp is operated at a lamp voltage of between about 60 V to 70 V and at a lamp current in the order of about 0.6 A.

* * * * *